US008205974B2

(12) United States Patent
Ogura et al.

(10) Patent No.: US 8,205,974 B2
(45) Date of Patent: Jun. 26, 2012

(54) INK TANK AND PRINTING APPARATUS

(75) Inventors: Hideki Ogura, Yokohama (JP); Yasuo Kotaki, Yokohama (JP); Tetsuya Ohashi, Matsudo (JP); Hitoshi Takada, Yokohama (JP); Koichi Kubo, Yokohama (JP); Ryoji Inoue, Kawasaki (JP); Tatsuo Nanjo, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 360 days.

(21) Appl. No.: 12/672,505

(22) PCT Filed: Oct. 10, 2008

(86) PCT No.: PCT/JP2008/068913

§ 371 (c)(1),
(2), (4) Date: Feb. 5, 2010

(87) PCT Pub. No.: WO2009/048174

PCT Pub. Date: Apr. 16, 2009

(65) Prior Publication Data

US 2011/0096128 A1 Apr. 28, 2011

(30) Foreign Application Priority Data

Oct. 12, 2007 (JP) ..... 2007-266701

(51) Int. Cl.
*B41J 2/175* (2006.01)

(52) U.S. Cl. ..... 347/86

(58) Field of Classification Search ..... 347/85, 347/86, 87

See application file for complete search history.

(56) References Cited

U.S. PATENT DOCUMENTS

| | | | | |
|---|---|---|---|---|
| 6,033,063 | A | 3/2000 | Tomikawa et al. | 347/87 |
| 6,082,852 | A | 7/2000 | Soga et al. | 347/86 |
| 6,422,692 | B2 * | 7/2002 | Yamazaki et al. | 347/86 |
| 6,827,431 | B2 | 12/2004 | Kitabatake et al. | 347/86 |
| 6,916,085 | B2 | 7/2005 | Kotaki et al. | 347/49 |
| 7,134,747 | B2 | 11/2006 | Hayashi et al. | 347/86 |
| 7,762,654 | B2 * | 7/2010 | Kawamura et al. | 347/86 |
| 2006/0082626 | A1 | 4/2006 | Oikawa et al. | 347/86 |
| 2007/0052772 | A1 | 3/2007 | Kawamura et al. | 347/86 |
| 2008/0062231 | A1 | 3/2008 | Kubo et al. | 347/86 |
| 2010/0053280 | A1 | 3/2010 | Ohashi et al. | 347/86 |

FOREIGN PATENT DOCUMENTS

| | | |
|---|---|---|
| JP | 8-132633 | 5/1996 |
| JP | 9-300646 | 11/1997 |
| JP | 2007-090873 | 4/2007 |

OTHER PUBLICATIONS

PCT International Preliminary Report on Patentability and Written Opinion dated Apr. 22, 2010, from corresponding PCT Application No. PCT/JP2008/068913.

* cited by examiner

*Primary Examiner* — Anh T. N. Vo
(74) *Attorney, Agent, or Firm* — Fitzpatrick, Cella, Harper & Scinto

(57) ABSTRACT

An ink tank with a high volume efficiency and a printing apparatus which are capable of completely using up ink stored in the ink tank. A meniscus holding force (Pm1) of a non-compressed portion (22*b*) of an ink guide member (22) is set higher than an initial ink-storage-portion negative pressure (P1), and lower than a used-up ink-storage-portion negative pressure (P2). In addition, a meniscus holding force (Pm2) caused under compression is set stronger than the used-up ink-storage-portion negative pressure (P2), and weaker than a meniscus holding force (Phf) of a head filter (50).

9 Claims, 15 Drawing Sheets

INK TANK AND PRINTING APPARATUS

TECHNICAL FIELD

This invention relates to an ink tank and a printing apparatus using the ink tank. This invention can be applied to not only a general inkjet printer, but also apparatuses such as a copying machine, a facsimile machine having a communication system, and a word processor having a printing unit. In addition, this invention can be applied to industrial printing apparatuses multifunctionally combined with various processing apparatuses

BACKGROUND ART

In one of known types of inkjet printing apparatuses ejecting ink from a print head onto a print medium, ink is ejected during the movement of the print head across the print medium in order to print an image. Another type of inkjet printing apparatus prints an image by ejecting the ink from the print head while moving the print medium relative to the print head that is fixedly mounted.

Some methods for supplying ink to a print head which are employed in such inkjet printing apparatuses will be described below. One of them is the so-called "on-carriage method" in which ink is supplied from an ink tank that is attached integrally with or detachably to the print head which is mounted on a carriage or the like so as to reciprocate. Another method is the so-called "tube supply method" in which ink is supplied from an ink tank that is fixedly placed in an area of the printing apparatus independently of the print head mounted on the carriage and is fluidly connected to the print head through a flexible tube or the like. In the case of the "tube supply method", there is also a form of mounting a second ink tank for retaining the ink on the print head or the carriage between the ink tank and the print head.

In the inkjet printing apparatuses as described above, a mechanism for generating negative pressure is provided in the ink tank in order to prevent ink leakage from a print head nozzle. The mechanism can take the form of providing a porous member in the ink tank for retaining the ink and using the ink retaining force of the porous member impregnated with the ink to generate negative pressure. In another form, a bag made of a material having an elastic force such as rubber is filled with ink. Negative pressure is generated in the tank by causing a tension to act on the bag in the external direction.

In another known form, negative pressure is generated by using a spring or the like, provided inside or outside an ink storage portion formed of a flexible sheet, to urge the sheet member in a direction of expanding the sheet member. In some ink tanks employing the sheet member, a part of the sheet member is shaped in a protrusion form in order to contain a larger amount of ink. By use of the ink tank of this form, an inkjet printing apparatus improved in a print speed and an image quality is capable of supplying ink at a constant flow velocity and a flow rate, and also of using ink having various physical properties such as pigment ink.

When such an ink tank is used to supply ink to the print head, the structure of mounting a capillary member in a tank communication port is adopted in some cases as disclosed in Japanese Patent Laid-Open Nos. 08-132633 (1996) and 09-300646 (1997).

Next, the structure disclosed in Japanese Patent Laid-Open No. 08-132633 (1996) will be described.

The ink tank described in Japanese Patent Laid-Open No. 08-132633 (1996) comprises an ink storage portion and an intermediate chamber extending laterally from the bottom of the ink storage portion, and a capillary member provided in the ink storage portion. The ink tank has a negative-pressure generating mechanism which uses the capillary force of the capillary member to retain the ink. In addition, an ink supply portion is provided for supplying the ink from the ink storage portion to the outside of the ink tank. The ink supply portion is provided with a meniscus forming member having a great number of pores formed therein and a porous member which changes in volume between when the ink tank is attached and when it is detached. The porous member is formed of a material which changes in volume by a pressing force and has a high power of absorbing the ink, and formed in a tapered shape having a flat head.

The print head disclosed in Japanese Patent Laid-Open No. 08-132633 (1996) has an ink introduction portion connected to the ink supply portion of the ink tank. The ink introduction portion is provided with a sealing member placed in a position making contact with the outer periphery of the ink supply portion of the ink tank. Then, a filter is provided at an end of the ink path extending from the ink introduction portion to the ejection port. When the ink tank is removed, the porous member built in the ink supply portion is released from its compressed state approximately concurrently with the detaching of the ink tank, leading to an increase in the volume of the porous member itself and an increase in the porosity. As a result, an ink leak is prevented by the porous member absorbing the ink attempting to flow out of the ink tank which is being removed.

The basic structure of the ink tank disclosed in Japanese Patent Laid-Open No. 09-300646 (1997) is approximately the same as the structure of the ink tank disclosed in Japanese Patent Laid-Open No. 08-132633 (1996), but differs from it in that the ink supply portion is provided with a coupling capillary member, instead of the porous member. When the ink tank is mounted to the print head, the filter of the print head is in contact with the coupling capillary member of the ink tank. The coupling capillary member used has a higher density than that of the capillary member provided in the ink storage portion and generating a negative pressure in the ink tank.

However, in the ink tank described in Japanese Patent Laid-Open No. 08-132633 (1996), the porous member placed in the coupling between the print head and the ink tank widely changes greatly in volume and the entire porous member has a small force of holding the meniscus. In addition, the porous member is housed in the coupling between the joint portion and the ink introduction portion when it is in a uniform compressed state. For this reason, when the negative pressure in the tank increases during the operation using the ink tank, meniscus destruction occurs in the porous member during the operation, which may possibly cause air to be drawn toward the print head through the porous member. If the air is drawn into the print head, this makes it impossible to use up the ink, resulting in a reduction in the amount of ink available.

In the ink tank described in Japanese Patent Laid-Open No. 09-300646 (1997), if the contact area with the filter of the print head is smaller than the area of the coupling capillary member, even after the ink has run out, a portion of the ink remains in the coupling capillary member. As a result, the ink cannot be completely used up, leading to a possibility of a reduction in the efficiency of ink use.

In addition, the arrangement of an ink guide member in an ink supply port is known from Japanese Patent Laid-Open No. 2007-90873 which has proposed a combination of an enclosure, a flexible film and an elastic member used for generating a negative pressure to form an ink tank structured to directly store ink.

FIG. 13A and FIG. 13B are diagrams illustrating the ink supply portions of conventional ink tanks. These types of ink tank have an ink guide member 122 disposed in the ink supply portion. For example, in the structures disclosed in FIG. 13A, a thick ink guide member 122 is provided, and is in contact with an ink supply tube 151 while being mounted in a holder. This contact causes a compressed state of the ink guide member 122 particularly in the vicinity of a portion 122*a* making contact with the ink supply tube (that is, an area where the capillary force is relatively high), and a little-compressed state of a portion 122*b* of the ink guide member 122 on the side opposite to the contact area (that is, an area where the capillary force is relatively low and approximates one without compression). Then, as the ink is supplied, the negative pressure in the ink tank gradually increases. As a result, the area with a low capillary force is located between the ink tank and the ink supply tube, and it may possibly cause a situation that the ink supply path is split. This will make it impossible to fully draw the ink from the ink tank. In the structure illustrated in FIG. 13B, because a portion 122*c* around which the ink guide member 122 is located is strongly compressed, ink will remain in these portions.

DISCLOSURE OF THE INVENTION

It is an object of the present invention to provide an ink tank with a high volume efficiency and a printing apparatus which are capable of completely using up ink stored in the ink tank.

According to an aspect of the present invention, an ink tank detachably mounted on a print head ejecting ink, comprises:

an ink storage portion for storing the ink;

negative-pressure generating member provided in the ink storage portion for adjusting a negative pressure in the ink storage portion; and an ink supply portion connected to a connecting portion of the print head for supplying the ink to the print head and provided with an extendable ink guide member, the ink guide member comprising a compressed portion connected to the connecting portion when the ink guide member is connected to the connecting portion, and a non-compressed portion which is not connected to the connecting portion, wherein when the connecting portion and the ink guide member are connected, meniscus holding forces of the respective compressed and non-compressed portions of the ink guide member satisfy relationships that an initial negative pressure in the ink storage portion is smaller than the meniscus holding force of the non-compressed portion, the meniscus holding force of the compressed portion is smaller than a meniscus holding force of the connecting portion of the print head, and the meniscus holding force of the non-compressed portion is smaller than the meniscus holding force of the compressed portion, wherein the meniscus holding force of the non-compressed portion is smaller than a negative pressure in a boundary area between an adjustable region in which the negative-pressure generating member adjusts the negative pressure in the ink storage portion, and a region in which a negative pressure is higher than that in the adjustable region.

According to the present invention, when the ink is supplied to the print head, the ink guide member is divided into a compressed portion and a non-compressed portion. A meniscus holding force of the non-compressed portion of the ink guide member is determined as a value within a region in which the negative-pressure generating member can control the negative pressure. A meniscus holding force of the compressed portion of the ink guide member is determined stronger than the meniscus holding force of the non-compressed portion of the ink guide member and also stronger than the maximum negative pressure which can be controlled by the negative-pressure generating member. In consequence, it is possible to provide an ink tank with a high volume efficiency and a printing apparatus which are capable of completely using up ink stored in the ink tank. Further features of the present invention will become apparent from the following description of exemplary embodiments (with reference to the attached drawings).

BEST MODE FOR CARRYING OUT THE INVENTION

First Embodiment

A first embodiment of the present invention will be described below with reference to the accompanying drawings.

Structure of Inkjet Printing Apparatus

Figure 10:
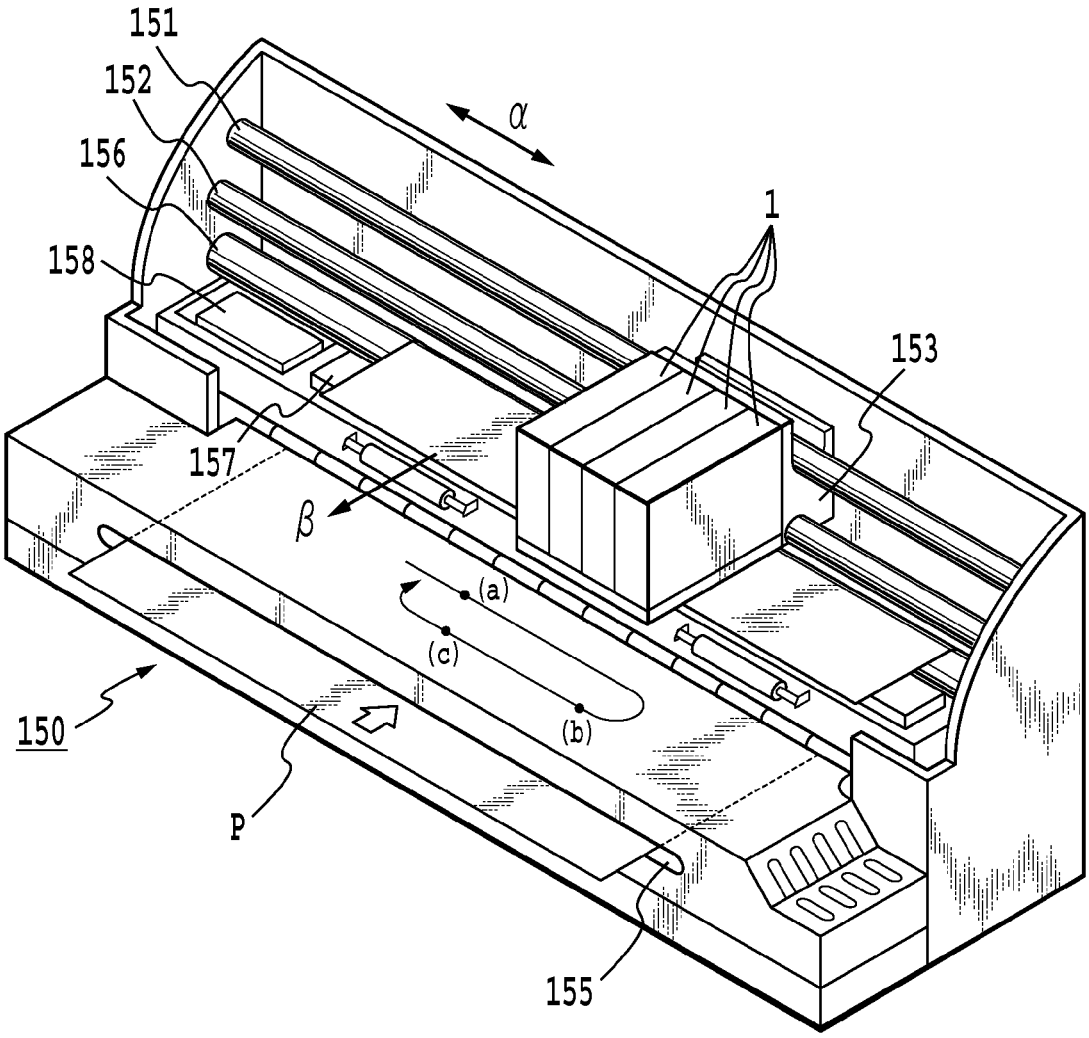
FIG. 10 is a diagram illustrating an example of the structure of an inkjet printing apparatus to which the present invention can be applied.

FIG. 10 is a diagram illustrating an example of the structure of an inkjet printing apparatus to which the present invention can be applied. The printing apparatus 150 is a serial scan type inkjet printing apparatus, which comprise guide shafts 151, 152 movably guiding a carriage 153 in the main scan direction α. The carriage 153 is reciprocated in the main scan direction α by a driving force transmission mechanism including a carriage motor, a belt for transmitting the driving force of the carriage motor, and the like. The carriage 153 can be detachably mounted with an inkjet print head (not shown) and ink tanks 1 for supplying ink to the print head. Four ink tanks 1 are mounted in the embodiment, but any number of ink tanks 1 mounted may be mounted as long as one or more ink tanks are mounted.

A print medium P is inserted from an insertion slot 155 provided in the front side of the apparatus, and then the feed direction of the print medium P is reversed, so that the print medium P is transferred in the sub scan direction of the arrow β by a feed roller 156. The printing apparatus 150 repeatedly performs the printing operation and the transfer operation in order to sequentially print an image on the print medium P. In the print operation, while the carriage 153 with the print head is moved in the main scan direction, ink is ejected toward a print area of the print medium P located on a platen 157. In the transfer operation, the print medium P is transferred in the sub scan direction by a distance corresponding to a width of an area printed by a print scan of the print head.

The print head may employ thermal energy generated by an electrothermal transducer as energy for ejecting the ink. In this case, the electrothermal transducer generates heat to cause film boiling in the ink, whereby the foam energy thus generated achieves the ejection of the ink from the ink ejection port. In this regard, the method of ejecting the ink from the print head is not limited to the method employing an electrothermal transducer, and, for example, a piezoelectric element may be used to eject ink.

A recovery system unit (recovery operation means) 158 is provided in the movement area of the carriage 153 and faces the face of the print head in which the ink ejection port is formed when the print head is mounted on the carriage 153. The recovery system unit 158 is provided with a cap capable of capping the ink ejection port of the print head, a suction pump which can introduce negative pressure into the cap, and the like. By introducing the negative pressure into the cap covering the ink ejection port, the ink is sucked and drained from the ink ejection port for the recovery operation in order to maintain a normal ink ejecting state of the print head. Further, the ink not contributing to the printing of the image is drained from the ink ejection port toward the inside of the cap, thereby performing the recovery operation (preliminary eject operation) for maintaining a normal ink ejecting state of the print head.

Figure 1:
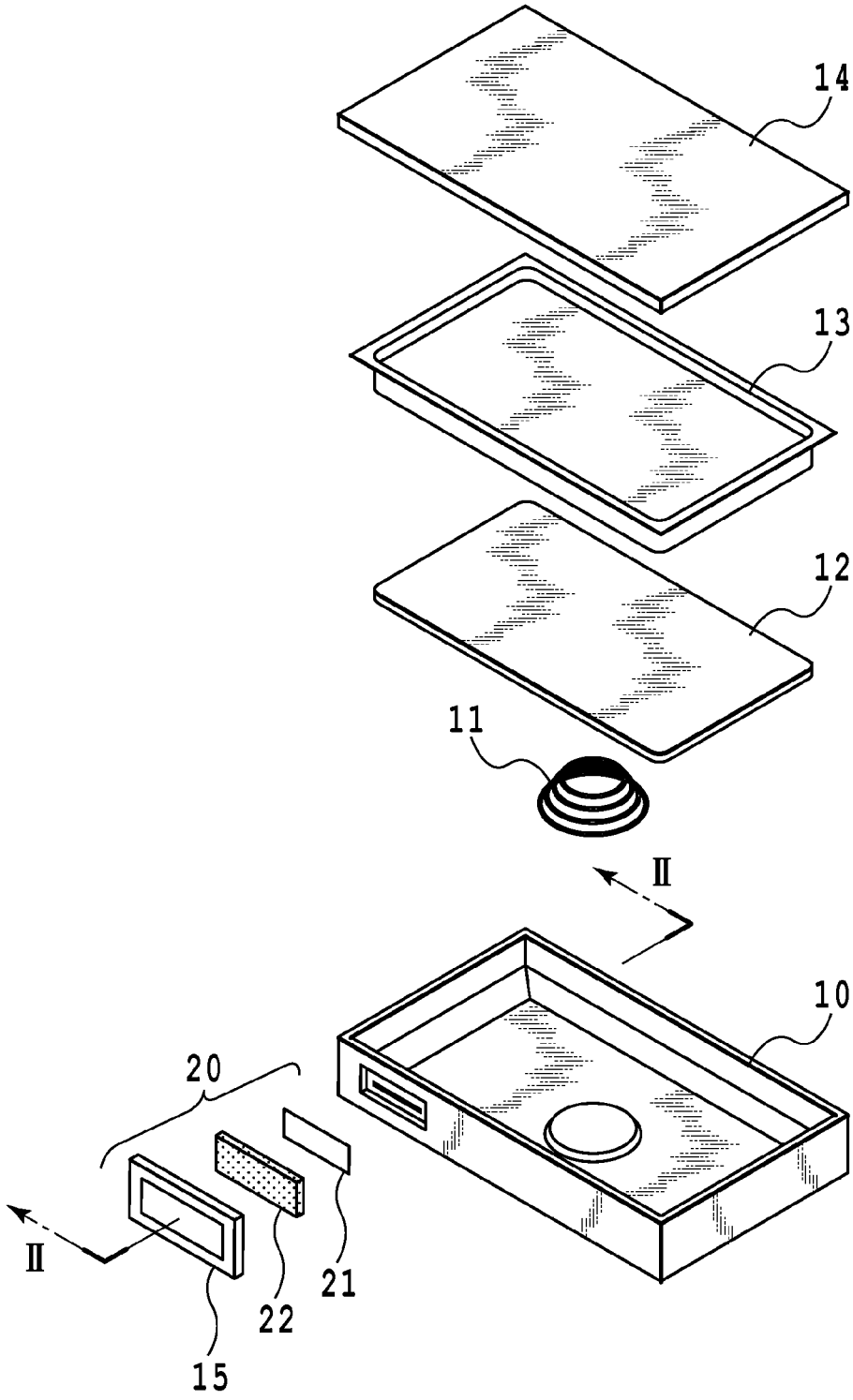
FIG. 1 is an exploded perspective view of an ink tank of an embodiment of the present invention.
Figure 2:
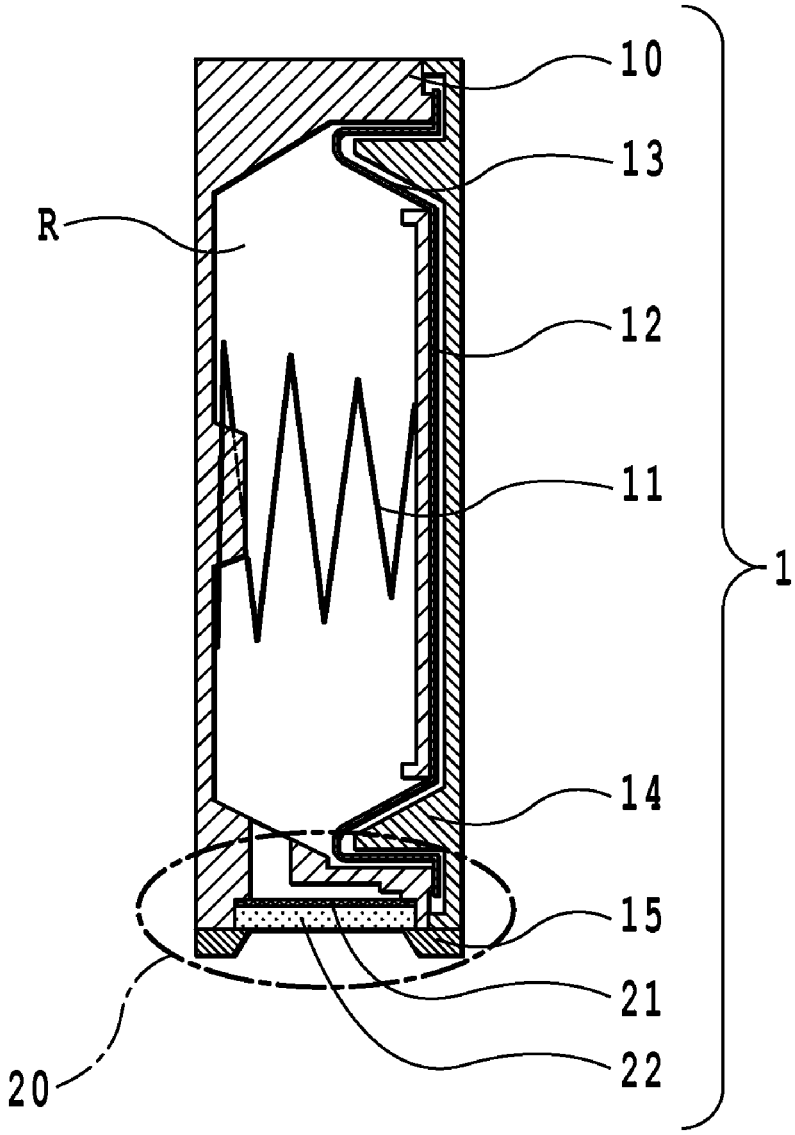
FIG. 2 is a sectional view of the assembled ink tank taken along the II-II line in FIG. 1.

FIG. 1 is an exploded perspective view of an ink tank 1 of the embodiment. FIG. 2 is a sectional view of the assembled ink tank 1 taken along the II-II line in FIG. 1. The following description is given with reference to FIGS. 1 and 2.

The ink tank 1 comprises a tank case 10, a spring member 11 which constitutes part of negative-pressure generating member, a pressure plate 12, a flexible member 13 and a lid member 14. The tank case 10 and the lid member 14 form the enclosure of the ink tank 1. An ink storage portion includes the pressure plate 12, the flexible member 13 and the lid member 14. Ink is stored in the ink chamber. The negative-pressure generating member is not limited to the above, and may be a porous member. The spring member provided in the negative-pressure generating member urges the ink storage portion in the outward direction. The ink tank 1 is a container for storing ink in the ink storage portion R defined by the tank case 10 and the flexible member 13, and is detachably installed in the inkjet printing apparatus in a position of pointing the ink supply portion 20 down as shown in FIG. 1. The ink supply portion 20 is connected to an ink supply path of an inkjet print head (hereinafter simply referred to as "print head") which will be described later. The ink tank 1 is capable of being disconnected from the print head. The tank case 10 has an ink supply portion 20 formed therein in such a manner as to be connectable to the print head. The ink supply portion 20 is provided with a meniscus forming member 21 and an extendable ink guide member 22.

Figure 3:
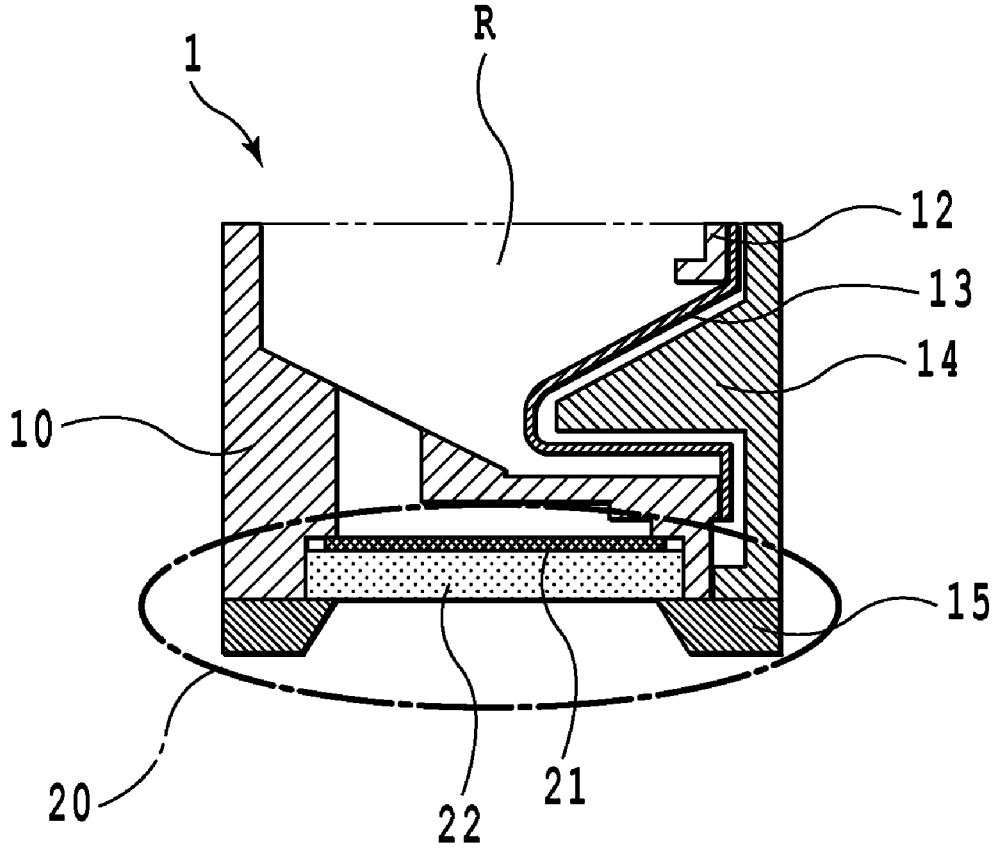
FIG. 3 is an enlarged view of an ink supply portion of the ink tank.

FIG. 3 is an enlarged view of the ink supply portion 20 of the ink tank 1. One of the opposing faces of the meniscus forming member 21 adjoins the ink storage portion R and the other face adjoins the ink guide member 22. The meniscus forming member 21 has a meniscus holding force which is stronger than the negative pressure in the ink storage portion R in order to prevent the intrusion of air from the ink supply portion 20 into the ink storage portion R which is kept at a negative pressure to hold the ink. The meniscus forming member 21 has a meniscus holding force of about 250 mmAq to about 350 mmAq, for example, so that meniscus is not broken by a negative pressure of about 100 mmAq to about 200 mmAq in the ink storage portion R. Materials for forming the meniscus forming member 21 are not limited to a mesh filter, and any material capable of achieving comparable effects to the mesh filter, such as resin fiber or metal fiber may be used.

The ink guide member 22, which is a feature of the present invention, is interposed and held between the meniscus forming member 21 and a member 15 provided on the outer opening of the ink supply portion 20 and pressed against the ink guide member 22, so as to be fixed in the bottom face of the ink retainer. The ink guide member 22 is formed of a material capable of being compressed in the vertical direction (the up-down direction in FIG. 1) in order to enhance the contact force of the ink supply portion 20 with a filter 50 of the later-described print head after the ink supply portion 20 has been connected to the print head to produce the ink supply state. For example, the present embodiment employs a fiber element formed of a material of polypropylene and having a fiber density of 0.01 $g/cm^3$ to 0.1 $g/cm^3$. Other appropriate materials, which may be used for the ink guide member, mainly include polyester, nylon, cellulose, polyurethane, and the like, and a preferable material is chemically stable toward the ink and has a high wettability. The contact depth ranges, for example, from 0.1 mm to 0.9 mm. The thickness of the ink guide member 22 ranges, for example, from 1 mm to 3 mm.

Figure 4A:
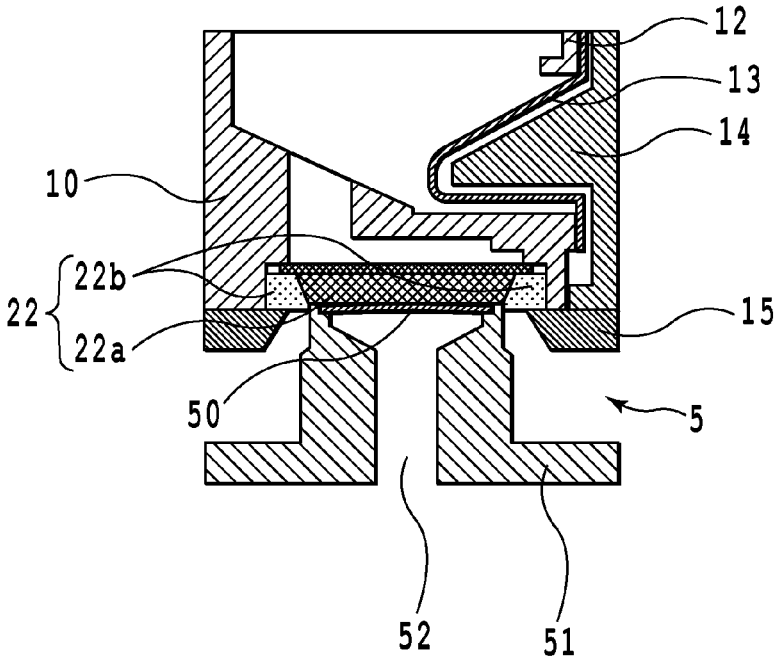
FIG. 4A is a sectional view of the ink tank connected to a connection portion of a print head.
Figure 4B:
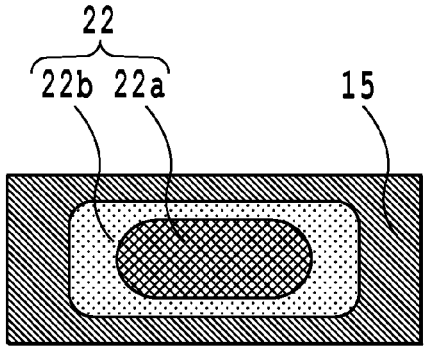
FIG. 4B is a sectional view of the ink tank alone when viewed from the ink tank connected to the print head.

FIG. 4A is a sectional view illustrating the connection state between a connection portion of the print head 5 and the ink tank 1. FIG. 4B is a sectional view of the ink tank 1 alone when viewed from the ink supply portion 20 when the ink tank 1 is connected to the print head 5.

The print head 5 comprises a head filter 50 provided at an end of an ink path 52. The ink tank 1 is connected such that a fluid connection is provided between the ink supply portion 20 and the ink path 52 of the print head 5. The fluid connection between the ink tank 1 and the ink path 52 of the print head 6 is achieved by causing the ink guide member 22 of the ink tank 1 to come into contact with the head filter 50 of the print head 5.

A first purpose of the ink guide member 22 is to guide the ink toward the print head 5 by being located in the ink-path connecting area between the print head 5 and the ink tank 1. For this purpose, a desirable material used for the ink guide member 22 is a low-density fiber element having a low flow resistance.

When the ink tank 1 is mounted on the print head 5, as shown in FIG. 4B, a portion of the ink guide member 22 making contact with the head filter 50 is compressed. That is, in the ink guide member 22 of the ink tank 1 mounted on the print head 5, a compressed portion 22*a* having a fiber density increased to exceed its initial fiber density by the compression, and a non-compressed portion 22*b* having a fiber density approximately equal to its initial fiber density before being compressed are produced. The compressed portion 22*a* and the non-compressed portion 22*b* are areas differing in density variations from each other.

Two components, the meniscus forming member 21 and the ink guide member 22, are used in the ink supply portion 20, so that the ink supply portion 20 achieves functional separation. Specifically, the meniscus forming member 21 has a function of preventing air from entering into the ink storage portion when the ink tank is subject to impact or drop during physical distribution. For this reason, the ink guide member 22 has a function of increasing the contact force produced in the vertical direction with respect to the plane of the meniscus forming member 21 when the ink tank is mounted on the print head 5 in order to guide the ink toward the print head after the ink tank has been mounted on the print head 5.

Figure 5:
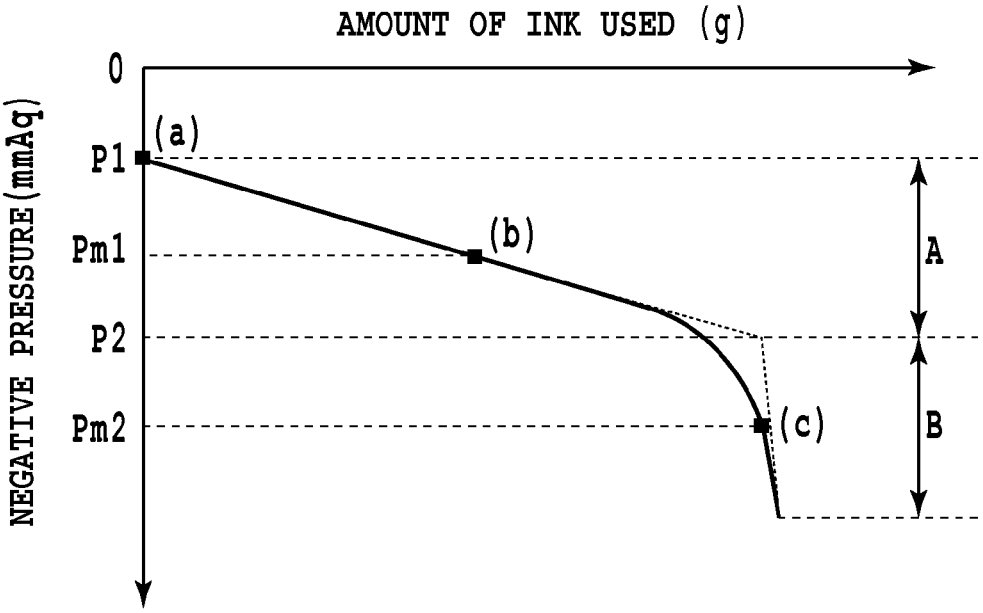
FIG. 5 is a graph showing negative pressure in the ink tank from the initial state when the ink tank is mounted on the print head to the final state when the ink in the ink tank is used up.
Figure 6A:
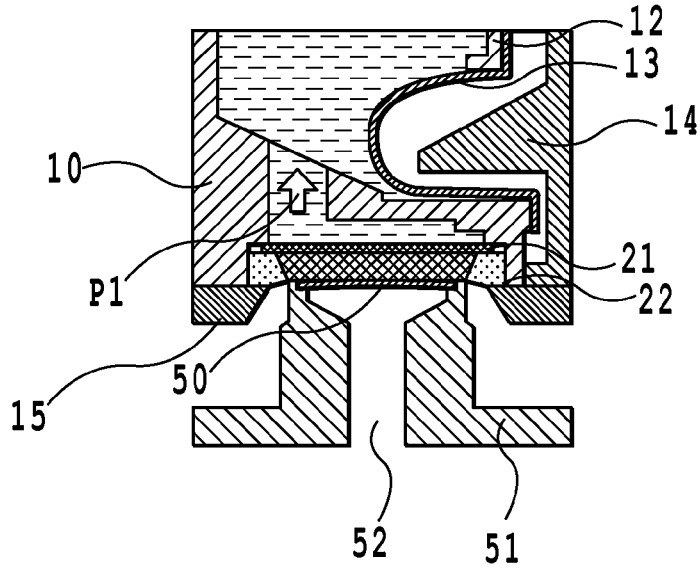
FIG. 6A is a view illustrating the initial state of the ink tank when it is mounted on the print head.
Figure 6B:
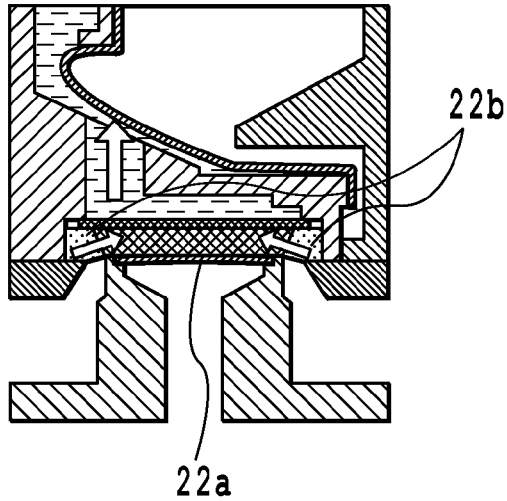
FIG. 6B is an enlarged view illustrating the supply portion when the amount of ink stored in the ink tank is decreased after the ink tank has been used over a certain period of time.
Figure 6C:
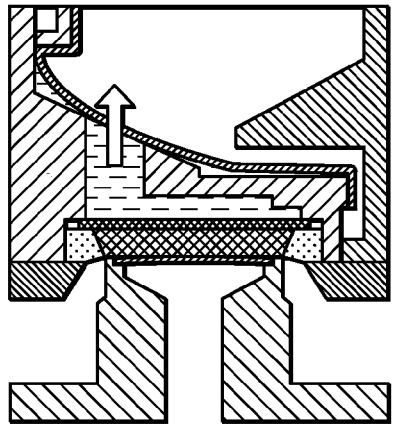
FIG. 6C is an enlarged view illustrating the supply portion after the ink has been used up.

FIG. 5 is a graph showing negative pressure in the ink tank 1 from the initial state when the ink tank 1 is mounted on the print head 5 to the final state when the ink in the ink tank 1 is used up. FIG. 6A to FIG. 6C are sectional views of the ink guide member 22 respectively corresponding to points (a) to (c) on the negative-pressure curve in FIG. 5.

A meniscus holding force Pm1 of the ink guide member 22 which is not compressed before the ink tank is mounted on the print head 5 is higher than an initial negative pressure P1 in the ink storage portion. This can be expressed as follows.

$$P1<Pm1 \quad (E)$$

The meniscus holding force Pm1 is higher than the meniscus holding force of the meniscus forming member 21.

For this reason, ink, instead of air, exists in the ink guide member 22. As a result, the ink tank 1 can be mounted on the print head 5 without drawing air (foam) into the ink tank because the surface of the ink guide member 22 comes into contact with the head filter 50 of the print head 5 at the time of being mounted on the print head 5.

FIG. 6A is a view illustrating the initial state of the ink tank 1 when it is mounted on the print head 5. The ink tank 1 is mounted on the print head 5, whereupon the ink in the ink tank 1 is pulled toward the head filter 50 to establish ink communication. At this point, a portion of the ink guide member 22 making contact with the head filter 50 is compressed, so that the compressed portion 22*a* and the non-compressed portion 22*b* are produced in the ink guide member 22. Because the compressed portion 22*a* is high in member density as compared with the non-compressed portion 22*b*, the compressed portion 22*a* has a higher ink retaining force. After the ink tank 1 is mounted on the print head 5, the meniscus holding force of the head filter 50 is higher than the negative pressure in the ink storage portion and the meniscus holding force of the ink guide member 22. As a result, the ink contained in the ink tank 1 is introduced into the print head 5. The following expression expresses the relationship between the meniscus holding force Pm2 of the ink guide member under compression and the meniscus holding force Phf of the head filter 50.

$$Pm2<Phf \quad (F)$$

FIG. 6B is an enlarged view illustrating the supply portion when the amount of ink stored in the ink tank 1 is decreased after the ink tank 1 has been used over a certain period of time. In the ink tank 1 according to the embodiment, as seen from the negative-pressure curve in FIG. 5, the negative pressure continuously builds up in the ink tank from the initial state of the ink tank to the final state when the ink is used up. This is because the flexible member 13 provided in the ink tank 1 is deformed along with the flowing-out of the ink and the spring 11 which is the negative-pressure generating member is continuously compressed. In this connection, when the meniscus holding force Pm1 of the ink guide member 22 which is not compressed is equal to the point (b) shown in FIG. 5, if the negative pressure in the ink tank becomes below the point (b) in FIG. 5, the ink in the non-compressed portion 22*b* is drawn into the print head. That is, in the present invention, the meniscus holding force Pm1 of the non-compressed portion 22*a* is in the region A between the initial negative pressure (P1) and the used-up negative pressure (P2). As a result, when the ink is used or used up, the ink retained in the non-compressed portion 22*b* is introduced toward the inside of the ink tank so as to be used up.

The relationship between the meniscus holding force Pm1 of the non-compressed portion of the ink guide member and the ink-storage-portion negative pressure P2 when the ink stored in the ink tank is used up is expressed as follows.

In this regard, the used-up ink-storage-portion negative pressure P2, herein described, is defined as a negative pressure in the boundary between the negative-pressure region A and the negative-pressure region B. The negative-pressure region A is referred to as a negative-pressure adjustable region in which the negative pressure is controlled by the spring member 11 which is the negative-pressure generating member. The negative-pressure region B is referred to as a region in which the negative pressure is higher than that in the negative-pressure region B and the negative-pressure generating member does not control the negative pressure.

$$Pm1<P2 \quad (G)$$

In this manner, the relationships between the negative pressures are specified. As a result, the ink retained in the non-compressed portion 22*b* in the ink guide member 22 can be used, thus improving the efficiency of ink use.

In a case of responding to an increase in ink flow rate in the printing operation in recent years and making full use of a high-viscosity ink such as pigment ink, because the flow resistance of the ink increases, there is a tendency to increase the area of the head filter 50. In this case, an ink guide member 22 with a large area is required, so that the non-compression portion 22*b* in the ink guide member 22 increases in size as well. If the ink remaining in the non-compressed portion 22*b* can be used for printing, the available amount of ink of the total amount of ink contained in the ink tank is increased, resulting in an improvement in volume efficiency.

FIG. 6C is an enlarged view illustrating the supply portion after the ink has run out.

It is necessary to prevent the print head 5 from sucking the foam to reduce in function after the ink retained in the non-compressed portion 22*b* has been used up. For this purpose, the compressed portion 22*a* of the ink guide member 22 has a negative pressure higher than the negative pressure P2 in the ink storage portion after the ink has run out in order to ensure the ink communicable state between the print head and the ink tank even after the ink has run out. This can be expressed as follows.

$$P2<Pm2 \quad (H)$$

By use of an ink guide member designed to satisfy the aforementioned relational expressions in the ink tank, when the ink tank is connected to the print head, the ink included in the non-compressed portion 122*b* of the ink guide member can be successfully introduced into the ink tank, resulting in an increase in the available amount of ink of the total amount of ink contained in the ink tank so as to improve the volume efficiency.

Figure 11A:
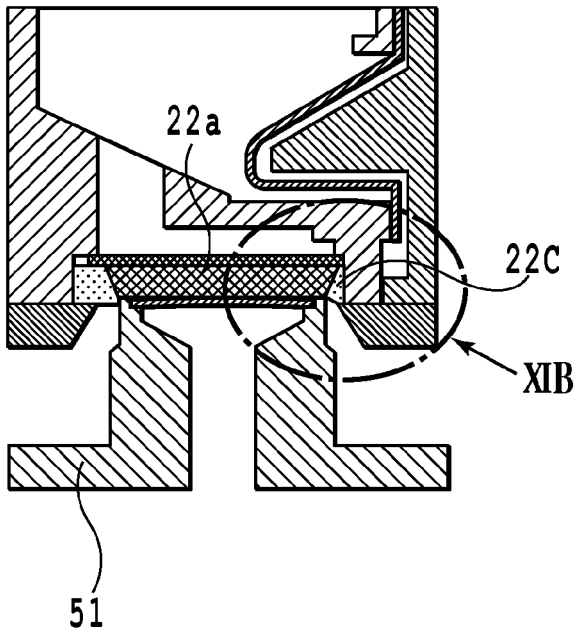
FIG. 11A is a sectional view illustrating the ink supply portion of the ink tank of the first embodiment.
Figure 11B:
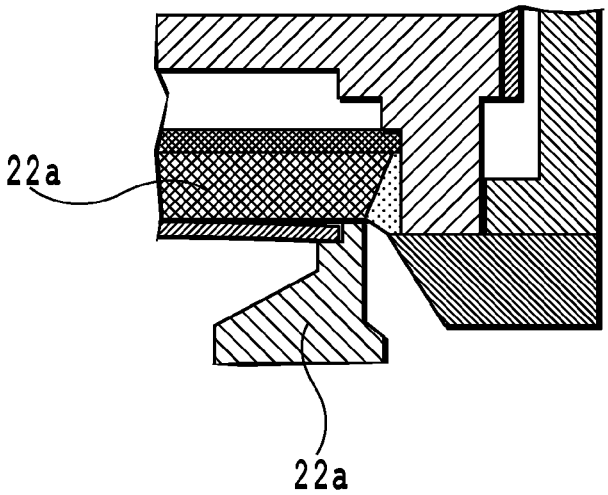
FIG. 11B is an enlarged view of a part of the ink supply portion in FIG. 11A.

The structure designed such that the area of the ink guide member 22 is larger than the area of the contact region with the ink supply tube 51 has been described. On the other hand, FIG. 11A illustrates the structure designed such that the ink supply tube 51 and the ink guide member 22 are approximately identical in contact region with each other. FIG. 11B shows an enlarged view of a part of the ink guide member 22 in FIG. 11A.

In the case of the structure shown in FIG. 11A, a non-contact portion 22*c* occurs in an extremely small region. This small region is affected by the contact with the ink supply tube 51, which shows a meniscus holding force Pm3 smaller than the meniscus holding force Pm2 of the compressed portion of the contact region but larger than the meniscus force Pm1 in the non-compression state. In this case, the aforementioned relationship is also satisfied.

In the ink supply portion 20 according to the present invention, when the ink tank 1 is removed from the print head, the ink remaining in the ink-path connecting area can quickly return and be received by the ink storage portion R of the ink tank 1, thus preventing ink-dripping. In addition, if the user accidentally drops the ink tank, the flying ink can be reduced.

Next, a method for measuring the negative pressure in the ink tank will be described as an approach for verifying the structure according to the present embodiment. A negative pressure in the ink tank and the state of the ink tank under the negative pressure can be associated with each other.

Figure 9:
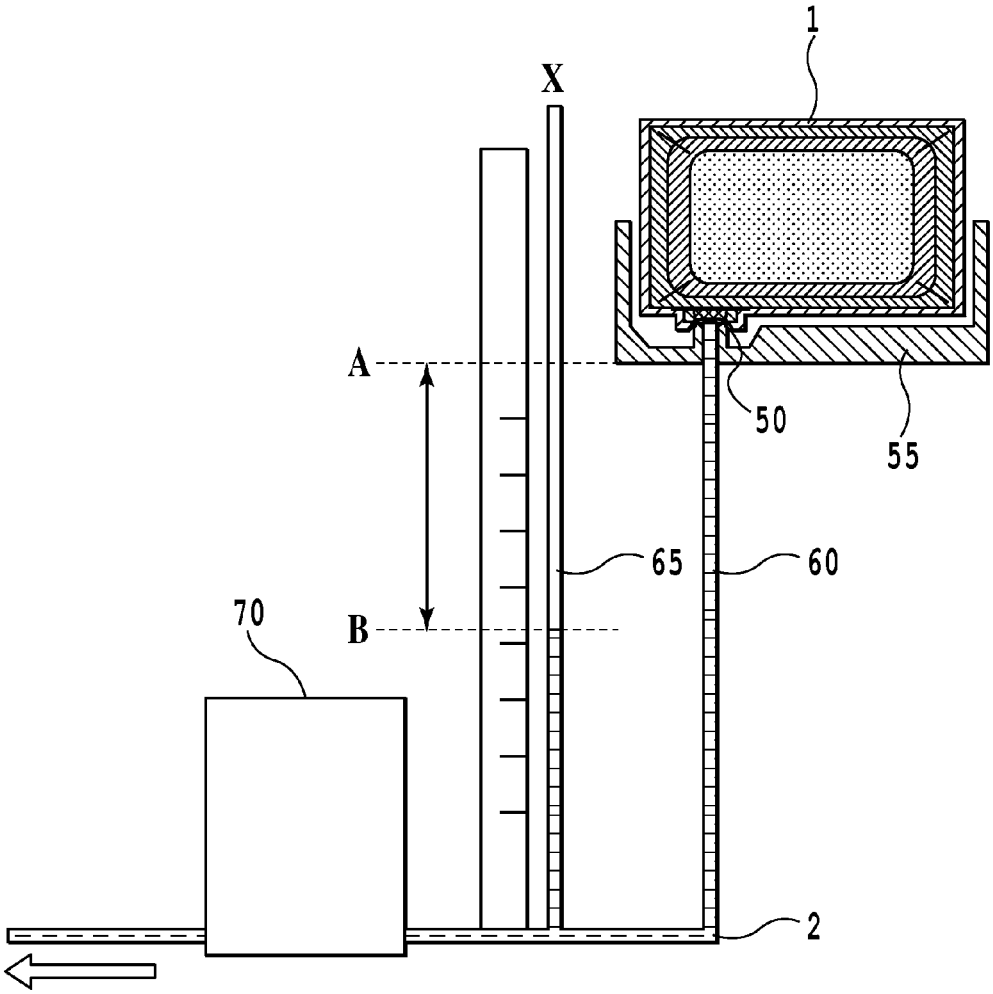
FIG. 9 is a diagram illustrating a method for measuring the negative pressure.

FIG. 9 is a diagram illustrating a method for measuring the negative pressure. A negative-pressure measuring jig imitates the print head 5 and a tank to be measured can be placed on the jig. The negative-pressure measuring jig comprises a head holder 55 to which the filter 50 is fixed and a tube 60 connected to the head holder 55 such that ink can flow from the head holder 55. In addition, the jig is provided with a tube pump 70 mounted on the tube 60 for generating the ink flow, and another tube 65 branching from the tube 60 between the pump 70 and the head holder 55. This structure is similar to the structure adopted for a method for obtaining a pressure difference using a U tube manometer.

First, the two tubes 60, 65 were filled with ink for preventing air from entering into the tubes. If air enters into the tubes, there is a possibility that a precise pressure cannot be measured due to the buffer effect of the air. In this state, an ink tank to be measured was mounted on the head holder 55, and was left until a liquid level in the tube on the X side in FIG. 9 stopped. Then, a difference between the position (B) of the liquid level and the ink-ejection-port face (A) of the head was read. This is an initial negative-pressure value.

Then, the tube pump was operated to cause the ink to flow from the ink tank as appropriate, and then was stopped when the amount of ink flowing out reached a position in which the measurement was required. As in the case of the foregoing, after a liquid level in the tube on the X side had stopped, a difference between the position (B) of the liquid level and the ink-ejection-port face (A) of the head was read. This process was repeatedly performed to plot a plurality of points respectively corresponding to the amounts of ink flowing out to obtain a curve showing negative pressures in the ink tank.

Then, the tank negative pressures at the respective points thus measured and states of the non-compressed portion and the compressed portion of the ink guide member were observed. It has been shown that foam does not enter into the tube 60 at the point where the ink in the ink tank completely runs out. In addition, the state in which the ink communication between the tank and the head is possible is verified. Further, it has been confirmed that the ink in the non-compressed portion 22*b* which is out of contact with the head filter 52 is used.

Next, an example of a method for examining the meniscus holding forces Pm1, Pm2 will be described.

Figure 12A:
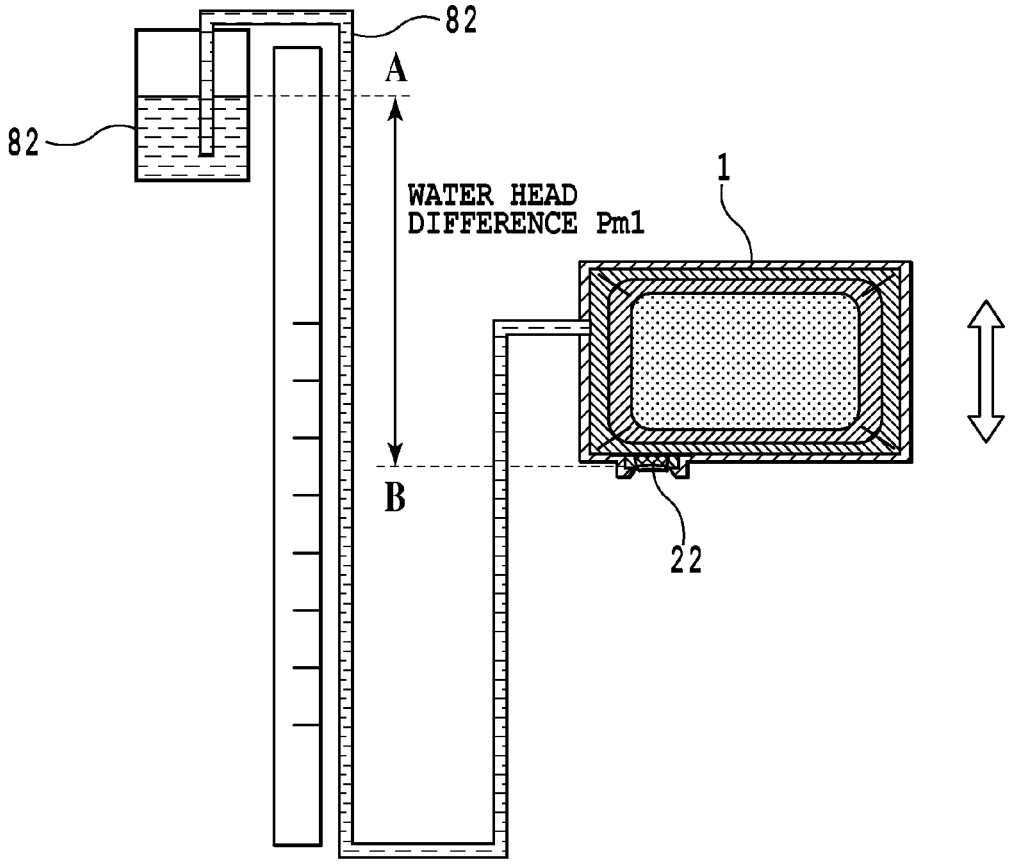
FIG. 12A is a diagram illustrating a method of measuring a meniscus force of the ink guide member when an ink guiding element is fitted to the ink tank.
Figure 12B:
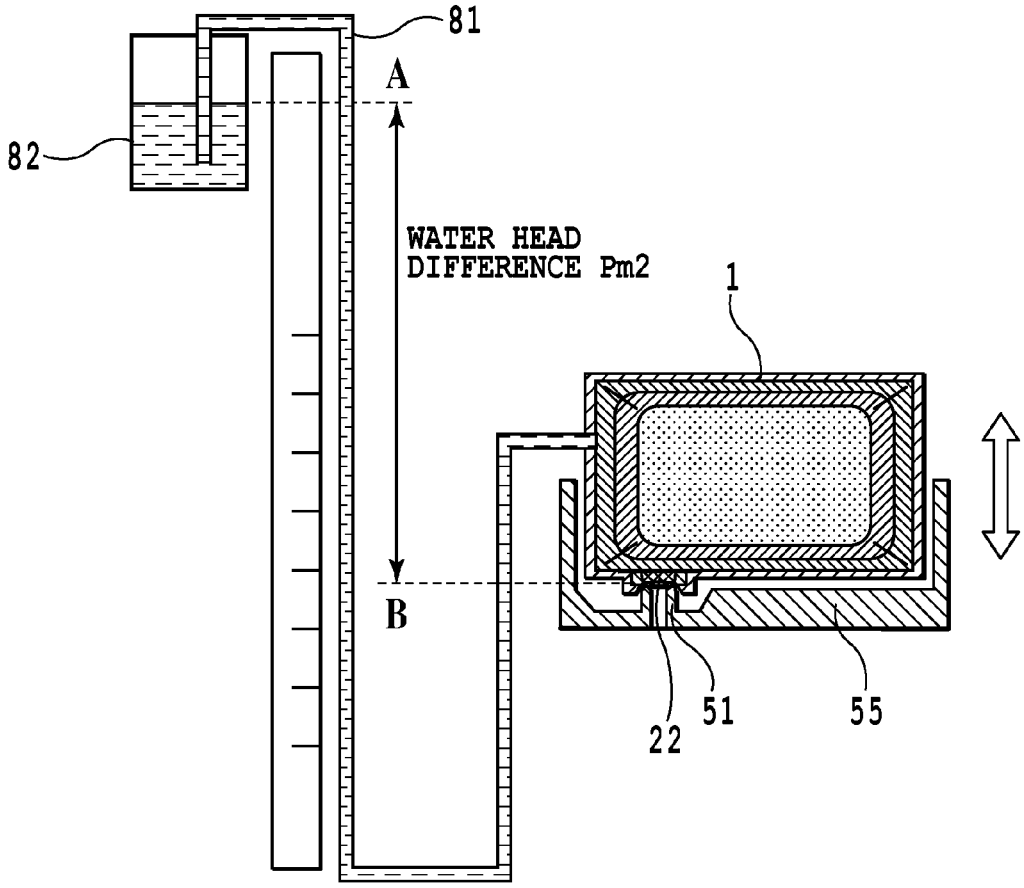
FIG. 12B is a diagram illustrating another method of measuring a meniscus force of the ink guide member when an ink guiding element is provided in the ink tank.
Figure 13A:
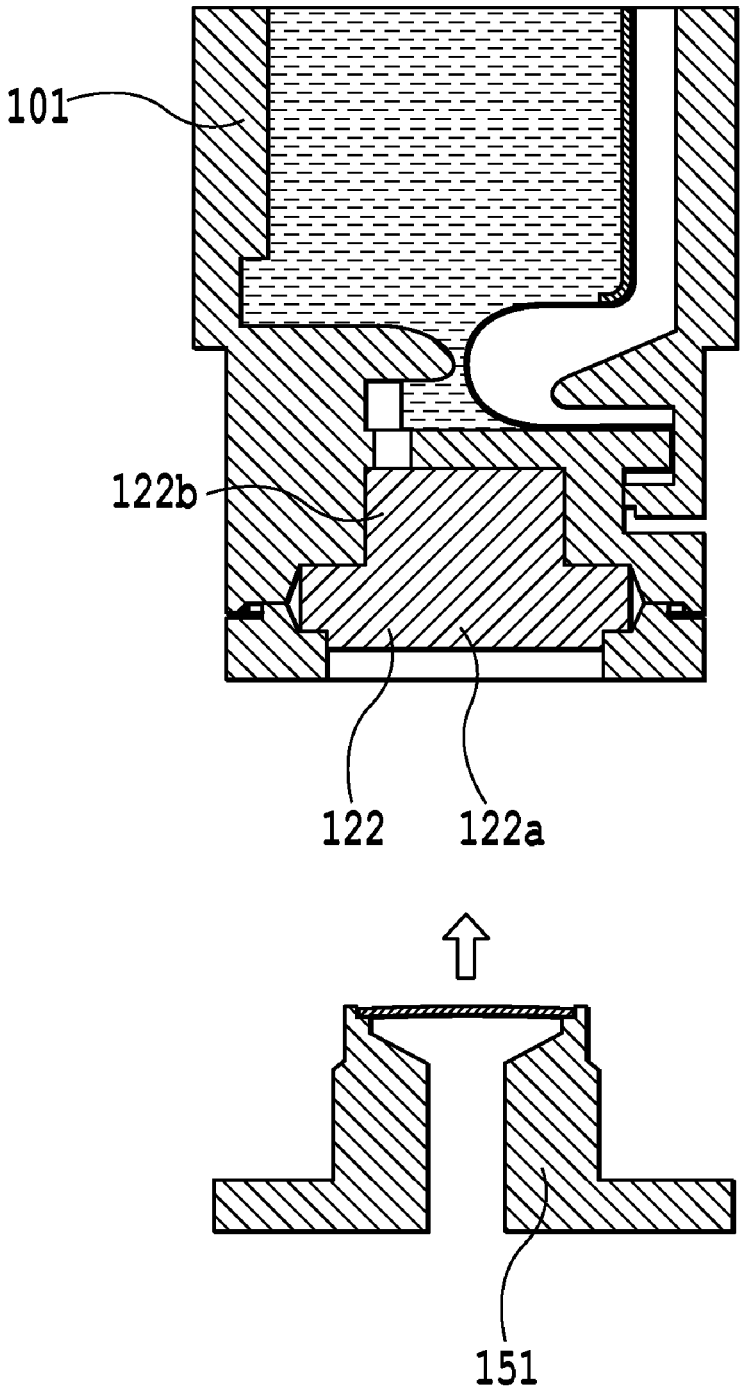
FIG. 13A is a sectional view illustrating an ink supply portion of a conventional ink tank.
Figure 13B:
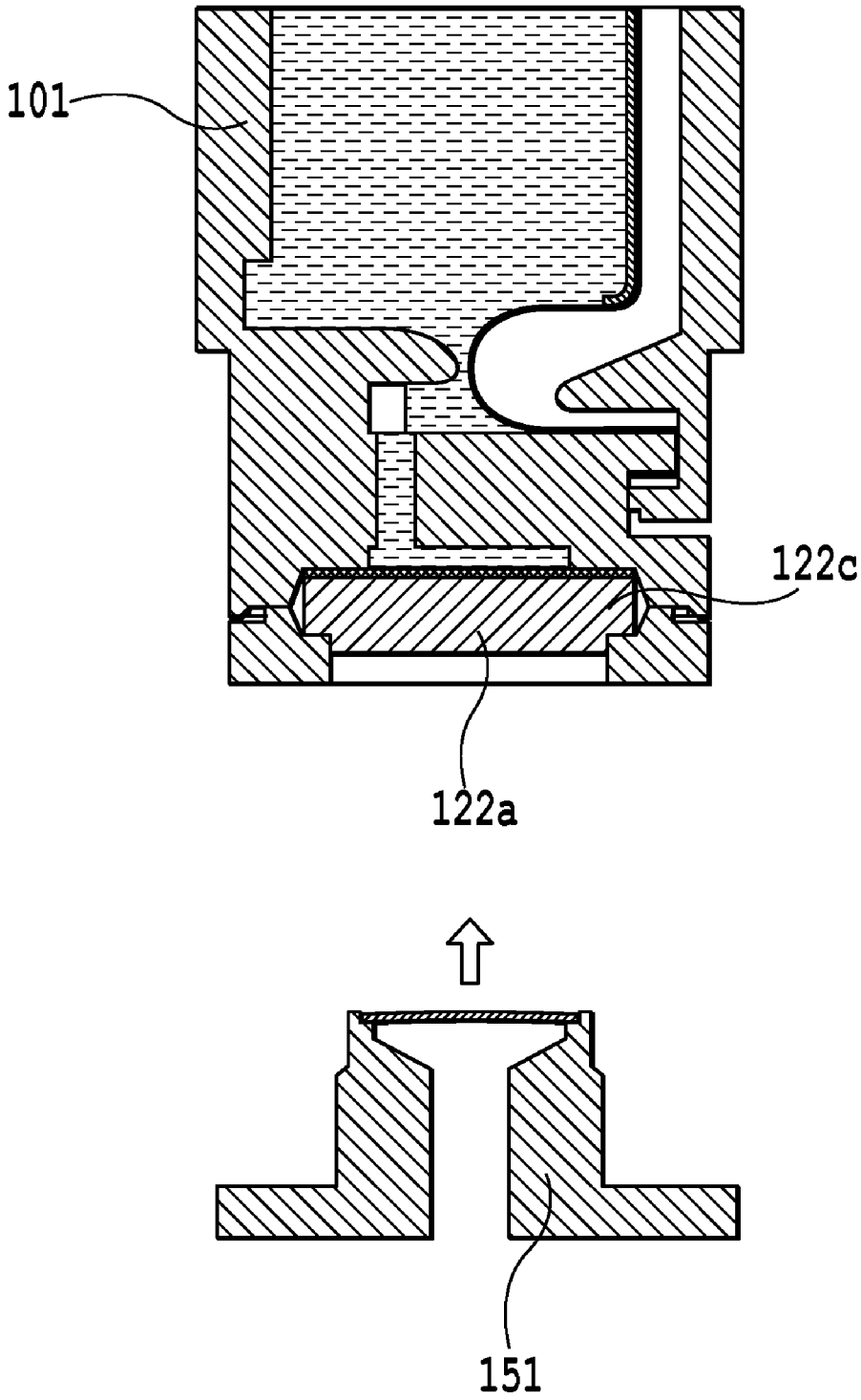
FIG. 13B is a sectional view illustrating an ink supply portion of another conventional ink tank.

FIG. 12A illustrates a method of measuring the meniscus force of the ink guide member when the ink tank 1 is equipped with an ink guiding element 22. The function of the negative-pressure source of the ink tank is rendered inoperative, and then the ink tank is filled with ink. The ink tank filled with the ink is connected through a tube 81 or the like to an ink container 82 which is open to the atmosphere. In this state, the ink tank 1 is moved up and down, and when the state in which the ink does not leak from the ink guide member 22 and air is not drawn into the ink tank (i.e., the stable ink-retaining condition) occurs, the liquid level of the ink container 82 and the height of the position of the ink guide member 22 (i.e., to measure a water head difference) are measured. This height represents a meniscus force Pm1 of the ink guide member in the non-compressed state. A meniscus is also measured when the ink tank 1 is placed on the holder 55 and the ink guide member 22 is compressed by the ink supply tube 51. For this measurement, as illustrated in FIG. 12B, a holder 55 is prepared, which is structured such that a meniscus force is not produced in the ink supply tube 51. The ink tank 1 is mounted on this holder 55. Then, as in the above case, when the ink guide member 22 stably retains the ink, the liquid level of the ink container 82 and the position of the ink guide member 22 are measured. The result of the measurement represents a meniscus force Pm2 of the ink guide member in the compressed state.

In a spring-bag type structure of an ink tank as disclosed in the present invention, the generation of the negative pressure in the spring-bag is prevented by performing, for example, a process of boring the spring-bag or the like. Then, ink is added to the ink in the ink tank until it is full, or alternatively the ink tank is filled with measurement liquid instead of ink. Then, the aforementioned measurements are performed to measure meniscus forces of an ink guide member in the compressed state and the non-compressed state can be measured Second Embodiment Next, a second embodiment of the present invention will be described with reference the accompanying drawings.

Figure 7:
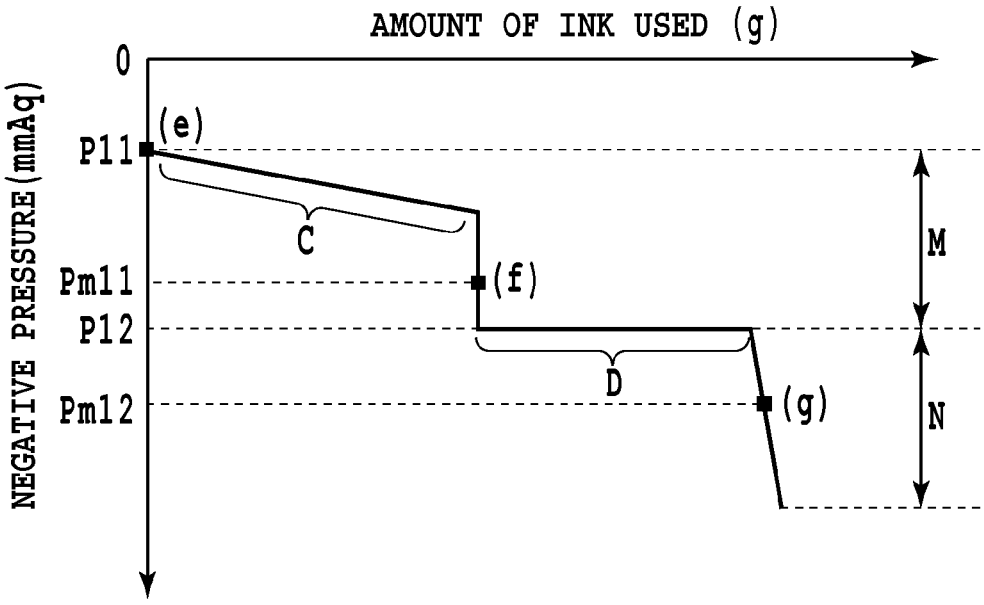
FIG. 7 is a graph showing negative pressure in the ink tank from the initial state to the final state in a second embodiment of the present invention.
Figure 8A:
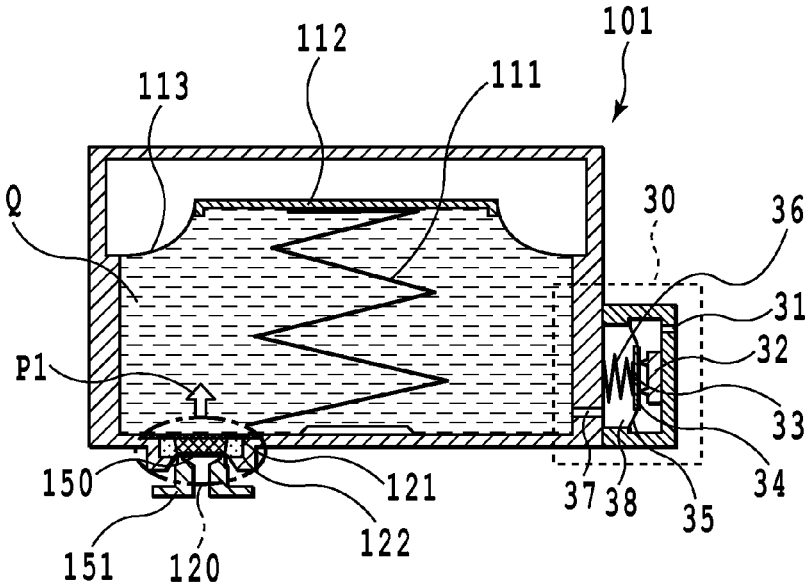
FIG. 8A is a sectional view illustrating the ink tank in the initial state when it is mounted on the print head.
Figure 8B:
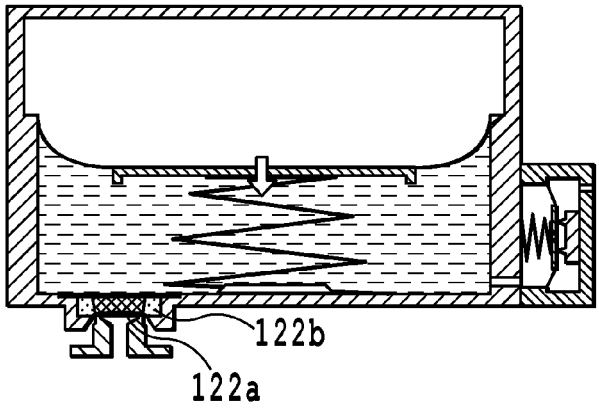
FIG. 8B is a sectional view illustrating the ink tank when the ink in the ink guide member is consumed.
Figure 8C:
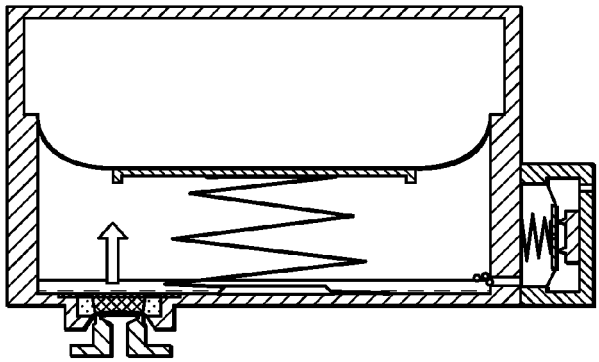
FIG. 8C is a sectional view illustrating the ink tank after the ink has been used up.

FIG. 7 is a graph showing negative pressure in the ink tank from the initial state when the ink tank according to the present invention is mounted on the print head 5 to the final state when the ink runs out. FIG. 8A to FIG. 8C are sectional views of the ink guide member respectively corresponding to points (e) to (g) on the negative-pressure curve in FIG. 7. FIG. 8A corresponds to the point (e) in FIG. 7 and illustrates "the tank-mounting initial state". FIG. 8B corresponds to the point (f) in FIG. 7 and illustrates "the state in which the meniscus holding force of the non-compressed area of the ink guide member 22 falls below the negative pressure in the ink tank, and the ink in the ink guide member is consumed". FIG. 8C corresponds to the point (g) in FIG. 7 and shows a cross section of "the ink tank after the ink has been used up". The following description is given using FIGS. 7, 8A, 8B and 8C.

The ink tank 101 of the second embodiment is provided with a one-way valve 30 as negative-pressure controling means for permitting the introduction of a gas from the outside into the ink tank 101 and for inhibiting the flow of liquid and the flow of gas from the ink tank 101 to the outside. The one-way valve 30 has a valve chamber 38 comprising a plate member 34, a flexible member 35 and a spring member 36. In the valve chamber 38 serving as the negative-pressure adjusting chamber, the plate member 34 has an air inlet 33 for introducing air from the outside. A sealing member 32 is provided on the outer periphery of the air inlet 33. The plate member 34 is urged toward the sealing member 32 by the spring member 32. The valve chamber 38 communicates with an ink storage portion Q. A pressure for introducing air into the ink storage portion Q is determined by the spring member 36 and the plate member 34. When the negative pressure in the ink storage portion Q is stronger than the pressure resulting from the air introduction, the plate member 34 is deformed so as to take air into the valve chamber 38. Then, the taken air is introduced from an air inlet 37 into the ink storage portion Q so as to maintain a constant negative pressure in the ink storage portion Q. The spring member 11 and the flexible member 13 form a function of maintaining or expanding the volume of the ink tank. This function is used as means for generating a negative pressure in the ink storage portion Q at the time when the use of the ink tank 101 is started.

The structure of an ink supply portion 120 is similar to that described in the first embodiment. The ink supply portion 120 achieves functional separation as having the function provided by a meniscus forming member 121 and the function provided by an ink guide member 122. The function of the meniscus forming member 121 prevents the intrusion of air into the ink storage portion when the ink tank is subject to impact or drop during physical distribution. The function of the ink guide member 122 guides the ink toward the print head after the ink tank has been mounted on the print head 5.

Since the ink tank 101 of the second embodiment makes an adjustment to pressure by means of gas introduction, a negative-pressure curve differing from that in the first embodiment is shown. In the first embodiment, the negative pressure continuously builds up along with the displacement of the spring. However, in the second embodiment, the negative-pressure curve is divided into two regions, the pressure fluctuation region (C) based on the initial negative-pressure generating portion and the constant negative-pressure region (D) based on the one-way valve 30.

As in the case of the first embodiment, in the second embodiment, a meniscus holding force Pm11 of the non-compressed portion 122*b* of the ink guide member 122 is higher than the initial ink-storage-portion negative pressure P11 in the ink storage portion in the initial state, and lower than the used-up ink-storage-portion negative pressure P12 in the ink storage portion in which the ink has run out.

That is, the meniscus holding force is set within the region M from the initial negative-pressure point (e) to the used-up point (g) in FIG. 7. This makes it possible to introduce the ink included in the non-compressed portion 122*b* into the ink tank in order to completely use up the ink.

The relationship among a meniscus holding force Pm12 generated under compression, the used-up ink-storage-portion negative pressure P12 and a meniscus holding force Phf of a head filter 150 is the same as those in the first embodiment, which is expressed by:

$$P12<Pm12<Phf \quad (I)$$

By setting up such conditions, the ink communicable state between the print head and the ink tank is ensured in order to prevent foam from entering into the print head to degrade the capability of the print head even after the ink has run out. In this regard, the used-up ink-storage-portion negative pressure P12 herein described is defined as a negative pressure in the boundary area between the negative-pressure region M and the negative-pressure region N. In the negative-pressure region M, the negative pressure is controlled by the valve chamber 30 which is the negative-pressure generating member. In the negative-pressure region N, the negative pressure is higher than that in the negative-pressure region M and the negative-pressure generating member does not control the negative pressure.

For the purpose of reducing the mounting force between the ink tank and the print head, the difference between the meniscus holding force Pm11 of the non-compressed portion 122*b* of the ink guide member 122 and the meniscus holding force Pm12 of the compressed portion 122*a* can be decreased. In order to decrease the difference between the two meniscus holding forces, the meniscus holding force Pm11 of the non-compressed portion 122*b* of the ink guide member may be set around the used-up negative pressure P12. When the meniscus holding force is determined in this way, the meniscus holding force Pm12 of the compressed portion 122*a* of the ink guide member can exceeds the used-up negative pressure P12 even when the displacement is small.

As described above, in the ink tank 101 comprising the negative-pressures adjusting mean, the meniscus holding force Pm11 of the non-compressed portion 122*b* of the ink guide member 122 is set higher than the initial ink-storage-portion negative pressure P11 and lower than the used-up ink-storage-portion negative pressure P12. In addition, the meniscus holding force Pm12 caused under compression is set stronger than the used-up ink-storage-portion negative pressure P12, and weaker than the meniscus holding force Phf of the head filter 150. As a result, the ink included in the non-compressed portion 122*b* of the ink guide member can be effectively led into the ink tank, resulting in an increase in the available amount of ink of the total amount of ink contained in the ink tank so as to improve the volume efficiency of the ink tank 101.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2007-266701, filed Oct. 12, 2007, which is hereby incorporated by reference herein in its entirety.

The invention claimed is:

1. An ink tank detachably mounted on a print head ejecting ink, comprising:

an ink storage portion for storing the ink;

negative-pressure generating member provided in the ink storage portion for adjusting a negative pressure in the ink storage portion; and an ink supply portion connected to a connecting portion of the print head for supplying the ink to the print head and provided with an extendable ink guide member, the ink guide member comprising a compressed portion connected to the connecting portion when the ink guide member is connected to the connecting portion, and a non-compressed portion which is not connected to the connecting portion, wherein when the connecting portion and the ink guide member are connected, meniscus holding forces of the respective compressed and non-compressed portions of the ink guide member satisfy relationships that an initial negative pressure in the ink storage portion is smaller than the meniscus holding force of the non-compressed portion, the meniscus holding force of the compressed portion is smaller than a meniscus holding force of the connecting portion of the print head, and the meniscus holding force of the non-compressed portion is smaller than the meniscus holding force of the compressed portion, wherein the meniscus holding force of the non-compressed portion is smaller than a negative pressure in a boundary area between an adjustable region in which the negative-pressure generating member adjusts the negative pressure in the ink storage portion, and a region in which a negative pressure is higher than that in the adjustable region.

2. The ink tank according to claim 1, wherein the connecting portion of the print head is provided with a filter.

3. The ink tank according to claim 1, wherein the ink guide member is formed of either resin fiber or metal fiber.

4. The ink tank according to claim 1, wherein the ink supply portion comprises a meniscus forming member having a meniscus holding force weaker than the meniscus holding forces of the ink guide member, and formed of either resin fiber or metal fiber.

5. The ink tank according to claim 4, wherein the ink guide member is interposed between the meniscus forming member fixed to a bottom face of the ink storage portion and a member provided on an opening of the ink supply portion and pressed against the ink guide member.

6. The ink tank according to claim 1, wherein the negative-pressure generating member is a porous member.

7. The ink tank according to claim 1, further comprising a one-way valve provided for permitting introduction of a gas from outside into the ink storage portion and for inhibiting a flow of liquid and a flow of gas from the ink storage portion to the outside.

8. The ink tank according to claim 1, wherein the negative-pressure generating member comprises an ink storage portion at least partially formed of a flexible material, and a spring member urging the ink storage portion in an outward direction.

9. A printing apparatus, comprising a carriage detachably mounted with the ink tank according to claim 1, and a print head provided on the carriage, wherein when the ink tank and a connecting portion of the print head are connected to each other, the connecting portion divides the ink guide member of the ink tank into the compressed portion and the non-compressed portion, ejecting the ink supplied from the ink tank for printing.

* * * * *